US009643420B2

(12) United States Patent
Yoshida et al.

(10) Patent No.: US 9,643,420 B2
(45) Date of Patent: May 9, 2017

(54) LIQUID DISCHARGE APPARATUS AND TUBE POSITION CORRECTING METHOD

(71) Applicant: SEIKO EPSON CORPORATION, Tokyo (JP)

(72) Inventors: Hirotaka Yoshida, Nakano-ku (JP); Daisuke Hiruma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/183,150

(22) Filed: Jun. 15, 2016

(65) Prior Publication Data

US 2016/0288509 A1 Oct. 6, 2016

Related U.S. Application Data

(63) Continuation of application No. 14/809,779, filed on Jul. 27, 2015, now Pat. No. 9,387,497.

(30) Foreign Application Priority Data

Jul. 28, 2014 (JP) ..... 2014-152631
Jul. 28, 2014 (JP) ..... 2014-152633

(51) Int. Cl.
*B41J 2/175* (2006.01)
*B05B 3/18* (2006.01)
*B41J 29/02* (2006.01)

(52) U.S. Cl.
CPC ..... *B41J 2/175* (2013.01); *B05B 3/18* (2013.01); *B41J 29/02* (2013.01); *B41J 2/17523* (2013.01)

(58) Field of Classification Search
CPC ..... B41J 2/17523; B41J 2/175
See application file for complete search history.

(56) References Cited

U.S. PATENT DOCUMENTS 5,043,746 A 8/1991 Abe
6,068,370 A 5/2000 Miller et al.
6,247,802 B1 6/2001 Gasso
7,175,265 B2 2/2007 Tsuyama et al.
8,646,885 B2 * 2/2014 Ishizawa ..... B41J 29/02 347/85
9,387,497 B2 * 7/2016 Yoshida ..... B05B 3/18
(Continued)

FOREIGN PATENT DOCUMENTS

JP 2003-211691 A 7/2003
JP 2006-082381 3/2006
JP 2006-102985 A 4/2006
(Continued)

*Primary Examiner* — Julian Huffman
*Assistant Examiner* — Michael Konczal
(74) *Attorney, Agent, or Firm* — Foley & Lardner LLP

(57) ABSTRACT

A liquid discharge apparatus includes a discharge portion capable of discharging a liquid, a carriage movable along scanning directions between a first position and a second position, a tube that is connected to the discharge portion and that supplies the liquid to the discharge portion, a frame provided at such a position as to be able to contact the tube, and a tube support portion that is provided between the frame and the carriage and that has a supporting surface capable of supporting the tube. The carriage includes an inclined portion that is inclined so as to move the tube toward the supporting surface when the carriage moves along the scanning directions while the tube is not supported by the supporting surface.

6 Claims, 11 Drawing Sheets

(56) References Cited

U.S. PATENT DOCUMENTS

2006/0192833 A1 8/2006 Samoto et al.

FOREIGN PATENT DOCUMENTS

| | | | |
|---|---|---|---|
| JP | 2006-231819 | A | 9/2006 |
| JP | 2009-056704 | A | 3/2009 |
| JP | 2010-131893 | A | 6/2010 |
| JP | 2012-158038 | A | 8/2012 |

* cited by examiner

LIQUID DISCHARGE APPARATUS AND TUBE POSITION CORRECTING METHOD

BACKGROUND

1. Technical Field

The present invention relates to a liquid discharge apparatus and a tube position correcting method.

2. Related Art

A recording apparatus equipped with a support portion that supports a tube connected to a carriage has been known (see, e.g., JP-A-2010-131893).

However, the foregoing apparatus has a problem that the tube falls off from the support portion due to, for example, an external factor or the like. The apparatus also has a problem that when the tube has fallen off from the support portion, the tube cannot easily be put back to the support portion.

SUMMARY

The present invention can be realized as configurations or application examples described below.

Aspect 1

A liquid discharge apparatus according to one aspect of the invention includes a carriage that has a discharge portion capable of discharging a liquid and that is movable along scanning directions between a first position and a second position, a tube that is connected to the discharge portion and that supplies the liquid to the discharge portion, a frame provided at such a position as to be able to contact the tube, and a tube support portion that is provided between the frame and the carriage and that has a supporting surface capable of supporting the tube. The carriage includes an inclined portion that is inclined so as to move the tube toward the supporting surface when the carriage moves along the scanning directions while the tube is not supported by the supporting surface.

According to this construction, if the tube falls off from the supporting surface while the carriage is moving between the first position and the second position, the tube is moved to the supporting surface side by the inclined portion provided on the carriage. Therefore, the tube having fallen off from the supporting surface can easily be put back to the supporting surface.

Aspect 2

In the foregoing liquid discharge apparatus, the inclined portion may include a scoop-up inclined portion that scoops up the tube from a position that is lower in a height than the supporting surface to the height of the supporting surface, the height meaning position in a gravity direction.

According to this construction, even when the tube is hanging downward in the gravity direction, the scoop-up inclined portion can easily scoop up the tube toward the supporting surface.

Aspect 3

In the foregoing liquid discharge apparatus, the inclined portion may include an urging inclined portion that urges the tube not in contact with the frame in a direction toward the frame.

According to this construction, the tube is pressed to the frame side by the urging inclined portion. Therefore, the tube having deviated from a predetermined position can easily be put back to the original position.

Aspect 4

In the foregoing liquid discharge apparatus, the inclined portion may be provided on at least one of the first position-side end portion and the second position-side end portion.

According to this construction, the position of the tube can be promptly corrected to the predetermined position when the carriage is moving at least one of the main scanning directions.

Aspect 5

In the foregoing liquid discharge apparatus, the inclined portion may be provided at each of the first position-side end portion and the second position-side end portion.

According to this construction, the position of the tube can be corrected regardless of the moving direction of the carriage.

Aspect 6

A tube position correcting method according to another aspect of the invention is a tube position correcting method for a liquid discharge apparatus that includes a carriage being movable along scanning directions between a first position and a second position and having a discharge portion capable of discharging a liquid, a tube that is connected to the discharge portion and that supplies the liquid to the discharge portion, a frame provided at such a position as to be able to contact the tube, and a tube support portion that is provided between the frame and the carriage and that has a supporting surface capable of supporting the tube. In the method, when the tube is not supported by the supporting surface, the tube is moved toward the supporting surface by moving the carriage along the scanning directions and causing an inclined portion provided on the carriage to contact the tube.

According to this construction, when the tube falls off from the supporting surface while the carriage is moving between the first position and the second position, the tube is moved toward the supporting surface by the inclined surface provided on the carriage. Therefore, the tube having fallen off from the supporting surface can easily be put back to the supporting surface.

Aspect 7

A liquid discharge apparatus according to the invention may include a discharge portion capable of discharging a liquid, a tube connected to the discharge portion and capable of supplying the liquid to the discharge portion, a frame provided at such a position as to be able to contact the tube, and a tube support portion that is provided between the discharge portion and the frame and that has a supporting surface capable of supporting the tube, and the supporting surface of the tube support portion may be inclined so that the tube is urged in a direction toward the frame.

According to this construction, the tube is supported by the supporting surface of the tube support portion. Note herein that the supporting surface of the tube support portion is inclined so that the tube is urged in the direction toward the frame. Therefore, a force acts on the tube in such a direction that the tube is pressed to the frame side. Therefore, the tube can be prevented from falling off from the tube support portion.

Aspect 8

The foregoing liquid discharge apparatus may further include a carriage on which the discharge portion is mounted and which is movable along scanning directions between a first position and a second position, and the tube may be supported by the supporting surface when the carriage is at the first position, and the tube may be apart from the supporting surface when the carriage is at the second position.

According to this construction, when the carriage moves between the first position and the second position, there occur a state in which the tube connected to the discharge portion is slackened and a state in which the tube connected to the discharge portion is unslackened. Therefore, when the tube is slackened (e.g., when at the first position), the tube is likely to deform in a direction in which the tube hangs down due to its own weight. Therefore, the tube is supported by the supporting surface. On the other hand, when the tube is unslackened (e.g., when at the second position), the tube is let apart from the supporting surface because the tube does not fall off from the supporting surface. Thus, an appropriate construction can be provided according to the state of the tube that changes as the carriage moves.

Aspect 9

The foregoing liquid discharge apparatus may further include a tube-holding member that is connected to the tube and that has a supported surface that contacts the supporting surface.

According to this construction, the tube-holding member is attached to the tube, and the supporting surface of the tube support portion and the supported surface of the tube-holding member are in contact with each other. That is, the tube and the supporting surface do not directly contact each other. Therefore, damages to the tube due to wear, abrasion, etc. can be prevented.

Aspect 10

In the foregoing liquid discharge apparatus, the supported surface of the tube-holding member may be inclined so as to follow inclination of the supporting surface.

According to this construction, the tube-holding member is urged to the frame side by the inclination of the supporting surface. Due to this, the falling off of the tube becomes less likely.

Aspect 11

In the foregoing liquid discharge apparatus, the supported surface of the tube-holding member may have a lower coefficient of dynamic friction than other portions of the tube-holding member.

According to this construction, the wear of the supporting surface and the supported surface due to friction between the supporting surface and the supported surface can be prevented.

Aspect 12

In the foregoing liquid discharge apparatus, the frame and the tube support portion may be provided so as to be continuous with each other.

According to this construction, the continuity between the frame and the supporting surface makes it less likely for the tube to fall off.

Aspect 13

A tube supporting method according to the invention may be a tube supporting method for a liquid discharge apparatus that includes a discharge portion capable of discharging a liquid, a tube that is connected to the discharge portion and the supplies the liquid to the discharge portion, and a frame provided at such a position as to be able to contact the tube. In the method, the tube may be supported between the discharge portion and the frame while being urged in a direction toward the frame.

According to this construction, the tube is supported by the supporting surface of the tube support portion. Note that the supporting surface of the tube support portion is inclined so that the tube is urged in the direction toward the frame. Therefore, a force acts on the tube in such a direction that the tube is pressed to the frame side. Therefore, the falling off of the tube from the tube support portion can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
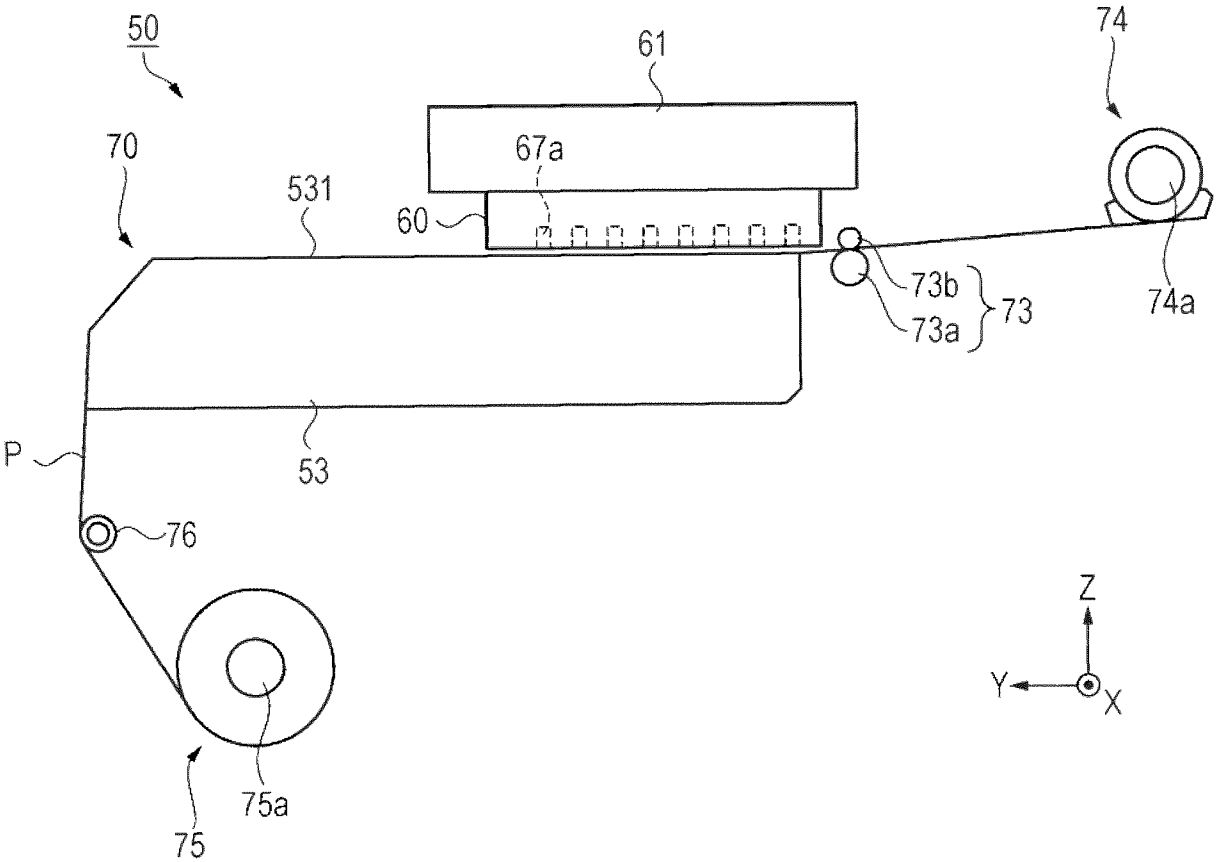
FIG. 1 is a conceptual diagram illustrating a construction of a liquid discharge apparatus according to Exemplary Embodiment 1 of the invention.

Exemplary embodiments of the present invention will be described hereinafter with reference to the accompanying drawings. In the drawings mentioned below, various members and the like are depicted in different scales such that the members and the like appear in easily recognizable sizes.

Exemplary Embodiment 1

First, a construction of a liquid discharge apparatus according to Exemplary Embodiment 1 will be described. The liquid discharge apparatus includes a carriage that has a discharge portion capable of discharging liquid and that is capable of moving along scanning directions between a first position and a second position, a tube that is connected to the discharge portion and that supplies liquid to the discharge portion, a frame provided at such a position as to be able to contact the tube, and a tube support portion that is provided between the frame and the carriage and that has a supporting surface capable of supporting the tube. The carriage has an inclined portion that is inclined so as to move the tube toward the supporting surface when the carriage moves along the scanning directions while the tube is not supported on the supporting surface. The liquid discharge apparatus is, for example, a ink jet printer. The liquid discharge apparatus will be concretely described below.

Figure 2:
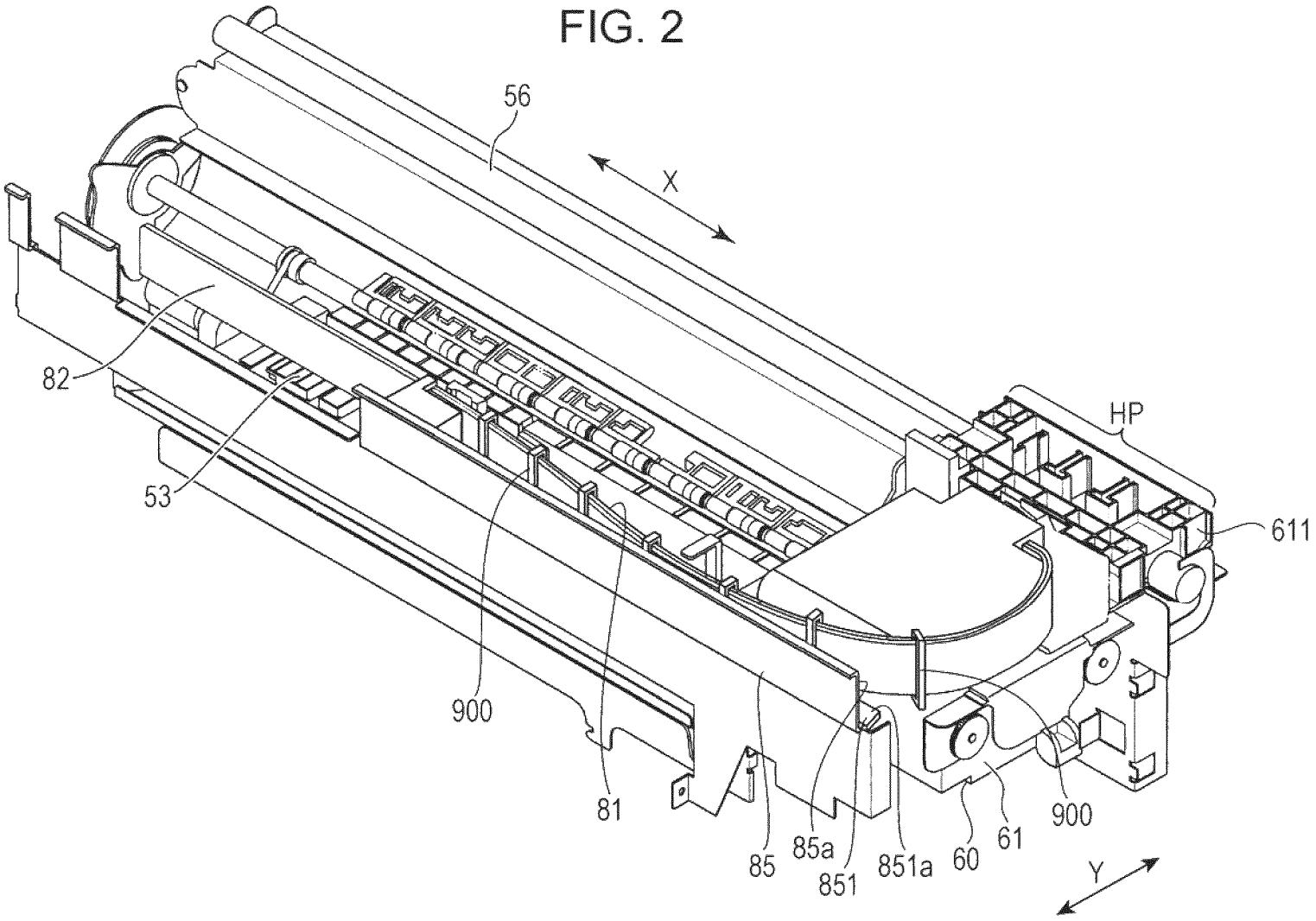
FIG. 2 is an enlarged partial diagram illustrating a construction of a portion of a liquid discharge apparatus.

FIG. 1 is a schematic diagram illustrating a construction of a liquid discharge apparatus according to Exemplary Embodiment 1. FIG. 2 is an enlarged partial view showing a construction of a portion of the liquid discharge apparatus. In FIG. 2, a construction when the carriage is disposed at a first position (home position HP) is shown. A liquid discharge apparatus 50 includes a transport apparatus 70 that transports a continuous sheet P of paper having a long sheet shape that is an example of a medium, a discharge portion 60 capable of discharging (ejecting) an ink that is an example of a liquid to the continuous sheet P transported by the transport apparatus 70, etc. The liquid discharge apparatus 50 includes a control unit (not shown in the drawings) that controls the transport apparatus, the discharge portion 60, etc.

The transport apparatus 70 includes a feed portion 74 that feeds the continuous sheet P and a take-up portion 75 that winds up the continuous sheet P on which printing has been performed by the discharge portion 60. In FIG. 1, the feed portion 74 is disposed at a right-side position that is at an upstream side in a transport direction Y (leftward direction in FIG. 1) of the continuous sheet P and the take-up portion 75 is disposed at a left-side position that is at a downstream side.

The discharge portion 60 is disposed at a position between the feed portion 74 and the take-up portion 75 so as to face a transport path of the continuous sheet P. The discharge portion 60 is, for example, a ink jet head. Then, a surface of the discharge portion 60 which faces the transport path of the continuous sheet P is provided with a plurality of nozzles 67*a* for ejecting the ink to the continuous sheet P. The discharge portion 60 is mounted on a carriage 61. The carriage 61 is disposed movably back and forth in main scanning directions X while being supported by a main guide shaft 56. The carriage 61 is connected to a drive electric motor (not shown), and is moved back and forth in the main scanning directions X by rotationally driving the drive electric motor.

A platen 53 that supports the continuous sheet P is disposed at a position that is across the transport path of the continuous sheet P from the discharge portion 60. The discharge portion 60 is disposed on the carriage 61 so that the surface having the nozzles 67*a* faces a platen surface 531.

As shown in FIG. 2, a tube 81 capable of supplying the ink from an ink container (not shown) to the discharge portion 60 is connected to the discharge portion 60. Furthermore, an FFC 82 extending from the control unit is connected to the discharge portion 60. Note that the "FFC" herein is an abbreviation of flat flexible cable. That is, the FFC 82 is a flat cable that has flexibility. The control unit outputs a drive signal to the discharge portion 60 through the FFC 82. The tube 81 and the FFC 82 are formed from materials that are flexible so as not to impede the back-and-forth motion of the carriage 61. In this exemplary embodiment, the tube 81 is held by a plurality of tube-holding members 900. The tube-holding members 900 have a function of clamping and bundling the tube 81 that is actually made of a plurality of tubes. This prevents tube 81 from flapping when the carriage 61 moves back and forth in the scanning directions X. This exemplary embodiment is constructed so that the FFC 82 as well as the tube 81 is held by the tube-holding members 900. Thus, the tube 81 and the FFC 82 are prevented from flapping.

Furthermore, a frame 85 is provided at such a position as to be able to contact the tube 81. More concretely, the frame 85 having a frame surface 85*a* along the main scanning directions X in which the discharge portion 60 (carriage 61) moves is disposed. A tube support portion 851 is provided between the discharge portion 60 and the frame 85. In this exemplary embodiment, the frame 85 and the tube support portion 851 are provided so as to be continuous with each other. The tube support portion 851 has a supporting surface 851*a* capable of supporting the tube 81.

The feed portion 74 is provided with a feed shaft 74*a* extending in width directions X of the continuous sheet P (in FIG. 1, directions orthogonal to the plane of the sheet) that are directions that intersect a transport direction Y of the continuous sheet P. The feed shaft 74*a* is capable of being rotationally driven. The continuous sheet P has, in advance, been wound in a roll state around the feed shaft 74*a* and supported so as to be rotatable together with the feed shaft 74*a*. Then, as the feed shaft 74*a* is rotationally driven, the continuous sheet P is fed out from the feed shaft 74*a* to the downstream side along the transport path.

On the downstream side of the feed shaft 74*a* in the transport direction of the continuous sheet P there is disposed a sheet feed roller pair 73 that is an example of a transport portion that guides toward the platen surface 531 the continuous sheet P transported from the feed shaft 74*a* while clamping the continuous sheet P. The sheet feed roller pair 73 is disposed at a position at the upstream side of the platen 53 in the transport direction Y. The sheet feed roller pair 73 has a sheet feed roller 73*a* provided so as to be capable of being rotationally driven and a sheet presser roller 73*b* that is driven following the rotation of the sheet feed roller 73*a*. The position at which the continuous sheet P is clamped between the sheet feed roller 73*a* and the sheet presser roller 73*b* is above the platen surface 531 of the platen 53.

Furthermore, at the downstream side of the platen surface 531 in the transport direction Y along the transport path of the continuous sheet P there is disposed a tension roller 76 for adjusting the tension of a printed region of the continuous sheet P. The take-up portion 75 is disposed at the downstream side of the tension roller 76 in the transport path of the continuous sheet P.

The take-up portion 75 is provided with a rotationally drivable take-up shaft 75*a* that extends in the width directions X of the continuous sheet P. As the take-up shaft 75 is rotationally driven, the printed continuous sheet P transported from the tension roller 76 side is gradually wound up by the take-up shaft 75*a*.

Figure 3:
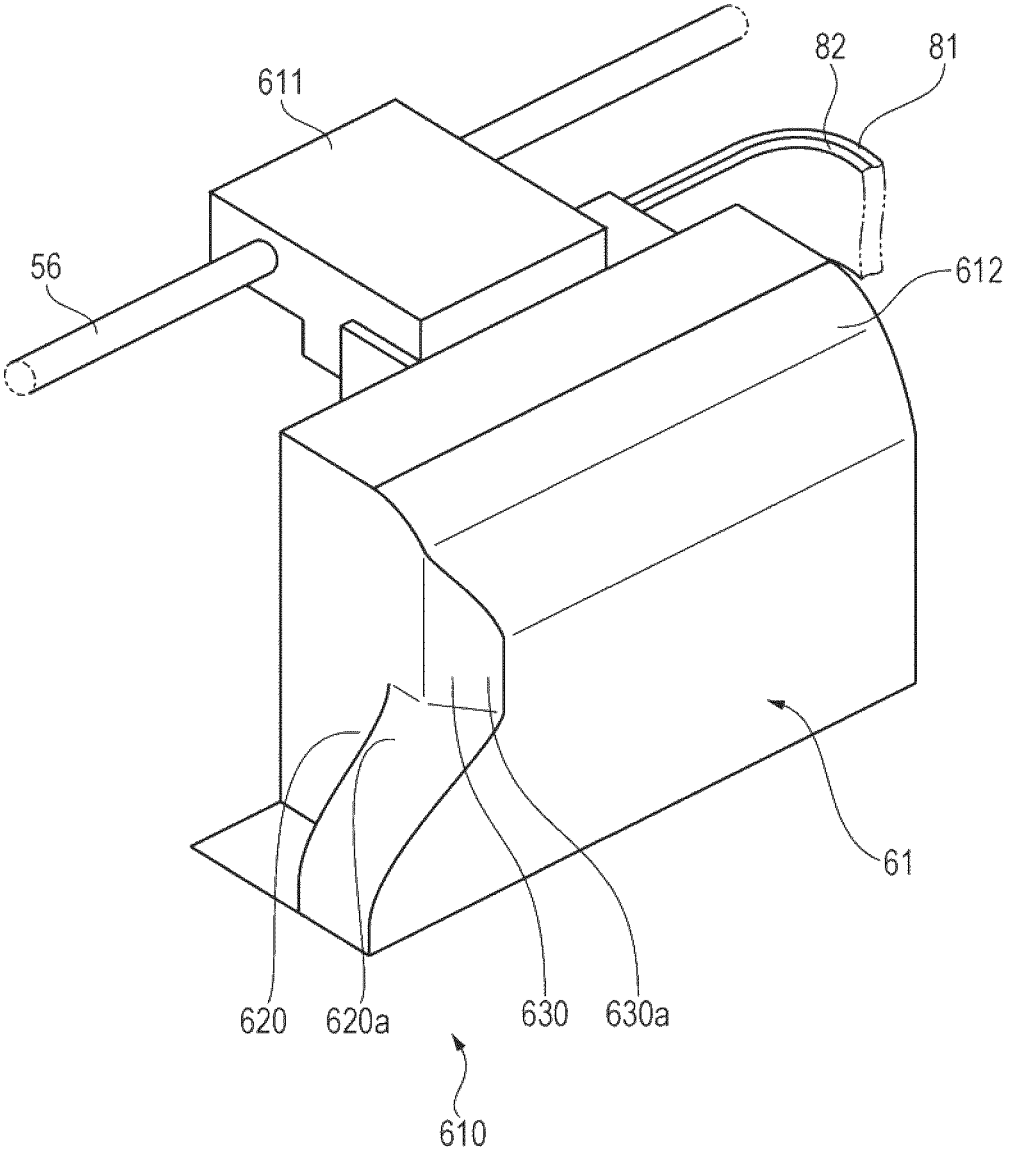
FIG. 3 is a conceptual diagram illustrating a construction of a carriage.
Figure 4:
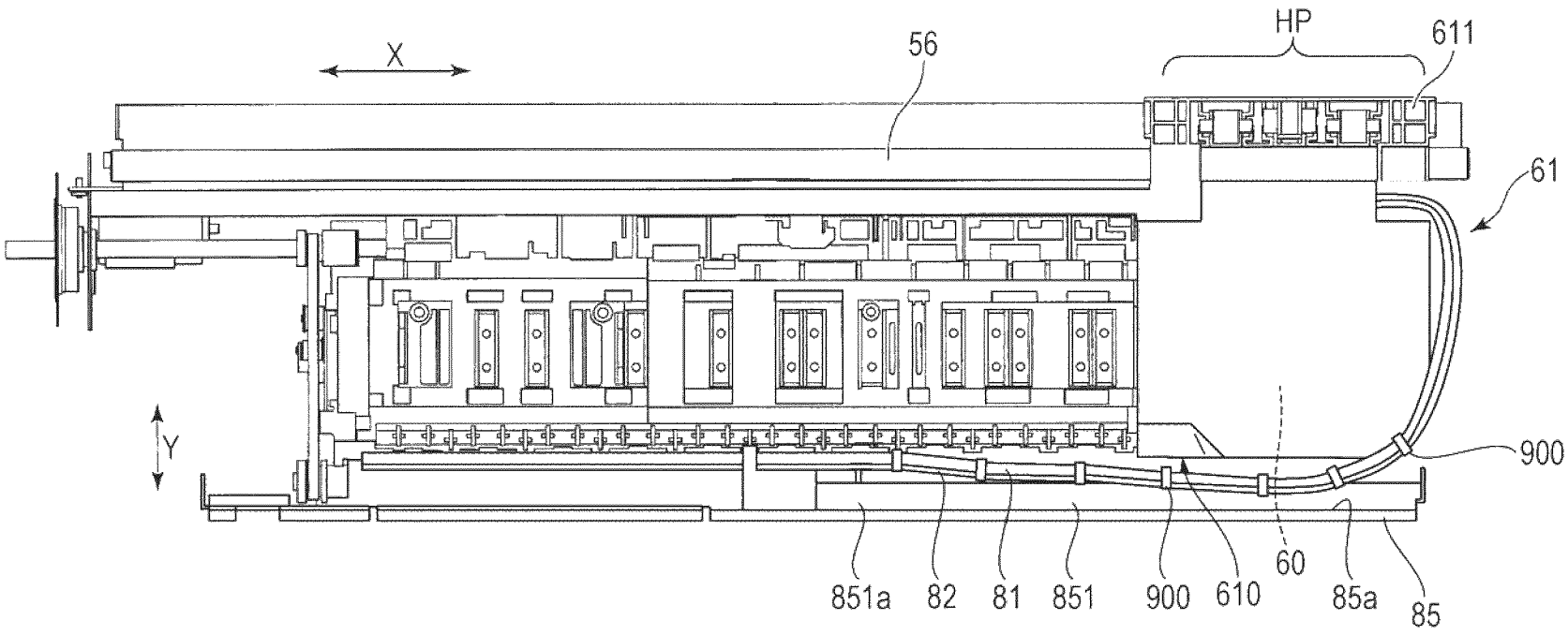
FIG. 4 is a schematic diagram illustrating an operation of a liquid discharge apparatus.
Figure 5:
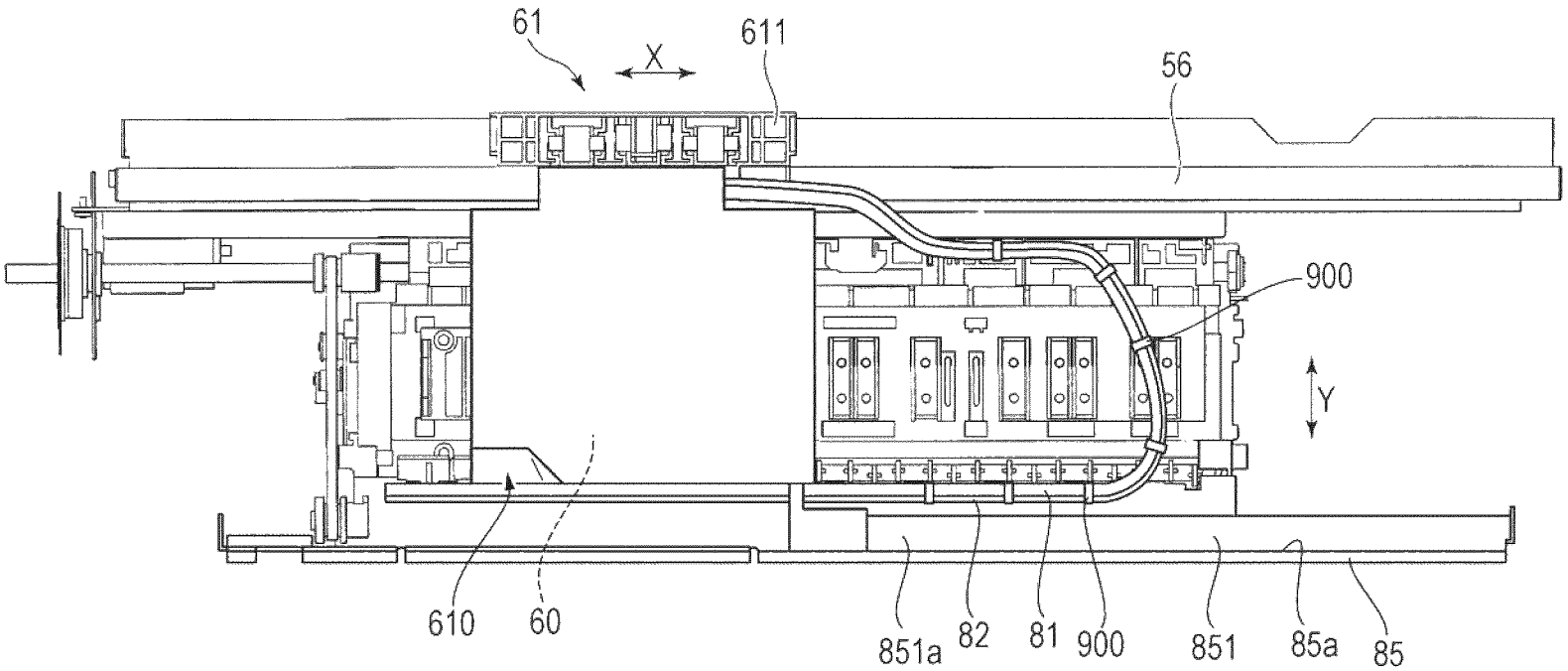
FIG. 5 is a schematic diagram illustrating an operation of the liquid discharge apparatus.

Next, a detail construction of the carriage will be described. FIG. 3 is a general illustration of a construction of the carriage. Furthermore, FIG. 4 and FIG. 5 are schematic diagrams illustrating an operation of the liquid discharge apparatus. More particularly, FIG. 4 illustrates a state where the carriage is at a first position (home position HP), and FIG. 5 illustrates a state where the carriage has moved to a second position (a position other than the home position HP).

The carriage 61 is capable of moving the discharge portion 60 along the scanning directions X (i.e., along an axis in the scanning directions X) between the first position and the second position. The carriage 61 includes an inclined portion 610 that is inclined so as to move the tube 81 toward the supporting surface 851*a* when the carriage 61 moves along the scanning directions X with the tube 81 not supported on the supporting surface 851*a*. Incidentally, in this exemplary embodiment, the carriage 61 is provided with a carriage cover 611 that covers the carriage 61. The inclined portion 610 is provided on an external surface of the carriage cover 611.

The inclined portion 61 is provided on at least one of a first portion-side end portion and a second position-side end portion of the carriage 61. Concretely, the inclined portion 610 is provided on at least one of an end portion of the carriage 61 and another end portion thereof opposite the end portion. In this exemplary embodiment, the inclined portion 610 is provided on an end portion that corresponds to a leading-side end in the moving direction of the carriage when the carriage 61 moves from the first position (home position HP) to the second position along the scanning directions X (i.e., along an axis in the scanning directions X) of the carriage 61. Concretely, the inclined portion 610 is provided on the second position-side end portion of the carriage 61. However, the inclined portion 610 may be provided on the first position-side end portion of the carriage 61.

The inclined portion 610 has a scoop-up inclined portion 620 that scoops up the tube 81 from a position that is lower in terms of a height that is position in the gravity direction than the supporting surface 851*a* to the height of the supporting surface 851*a*. Concretely, the scoop-up inclined portion 620 has a first inclined surface 620*a* for scooping up the tube 81 to the height of the supporting surface 851*a*. The height of the first inclined surface 620*a* in the gravity direction decreases gradually in the scanning direction X from the first position (home position HP) to the second position of the carriage 61. In other words, the height of the first inclined surface 620*a* is lowest at the end portion in the aforementioned scanning direction X of the carriage 61, and gradually increases toward a central portion of the carriage 61 in the scanning direction X. Incidentally, a top portion of the first inclined surface 620*a* is higher than the supporting surface 851*a*.

Furthermore, the inclined portion 610 has an urging inclined portion 630 that urges in a direction toward the frame 85 the tube 81 that is not in contact with the frame 85. Concretely, the urging inclined portion 630 has a second inclined surface 630*a* for urging the tube 81 to the frame 85 side. The second inclined surface 630*a* is inclined from an end portion toward a central portion of the carriage 61 in the scanning direction X.

In this exemplary embodiment, the scoop-up inclined portion 620 and the urging inclined portion 630 of the inclined portion 610 are formed continuously to each other. More concretely, the scoop-up inclined portion 620 is provided at a farthest end portion of the carriage 61 in the scanning direction X and the urging inclined portion 630 is disposed adjacent in the scanning direction X to the scoop-up inclined portion 620. Furthermore, the scoop-up inclined portion 620 is formed lower than, that is, below, the urging inclined portion 630.

Next, a tube position correcting method for the liquid discharge apparatus will be described. A tube position correcting method is a tube position correcting method for a liquid discharge apparatus that includes a carriage that is capable of moving between a first position and a second position along the scanning directions and that has a discharge portion capable of discharging a liquid, a tube that is connected to the discharge portion and that supplies the liquid to the discharge portion, a frame provided at a such a position as to be able to contact the tube, and a tube support portion that is provided between the frame and the carriage and that has a supporting surface capable of supporting the tube, the method including moving, when the tube is not supported on the supporting surface, the tube toward the supporting surface by moving the carriage along the scanning directions so that an inclined portion provided in the carriage contacts the tube. The method will be concretely described below.

Figure 6:
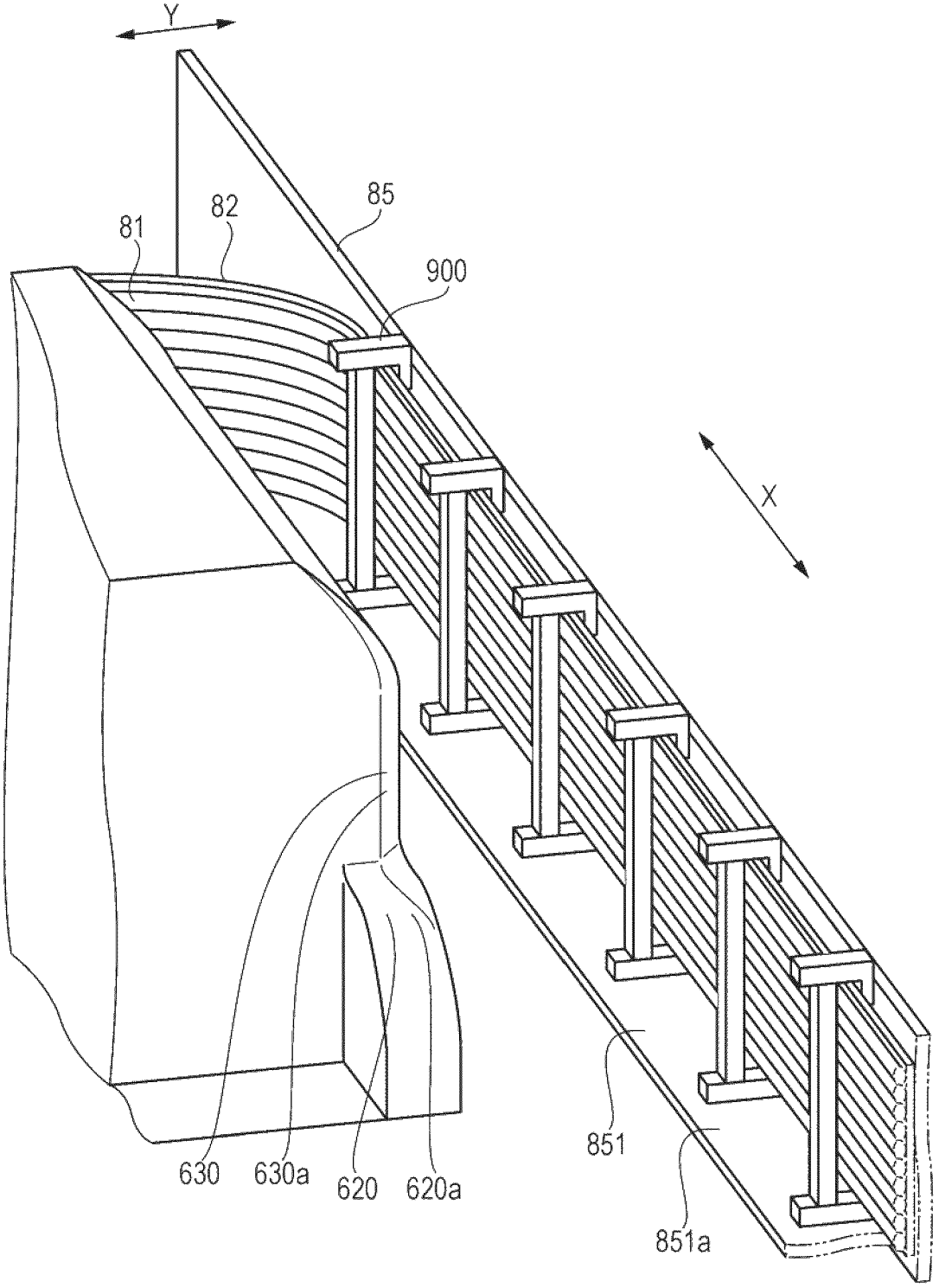
FIG. 6 is schematic diagram illustrating an operation of the liquid discharge apparatus.

FIG. 4 to FIG. 6 are schematic diagrams illustrating an operation of the liquid discharge apparatus. As shown in FIG. 4, when the carriage 61 is at the first position (home position HP), the tube 81 is supported by the supporting surface 851*a*. As shown in FIG. 5, when the carriage 61 is at the second position, the tube 81 is apart from the supporting surface 851*a*. More specifically, the region of the tube 81 that is apart from the supporting surface 851*a* is larger when the carriage 61 is at the second position than when the carriage 61 is at the first position. Specifically, when the carriage 61 is at the first position, the tube 81 droops due to its own weight and is likely to fall off from the supporting surface 851*a*. Therefore, a configuration that keeps the tube 81 supported on the supporting surface 851*a* as much as possible is adopted. However, when the carriage 61 is moved to the first position after having moved back and forth in the scanning directions X, the tube 81 can sometimes fall off from the supporting surface 851*a* due to the tube's 81 own weight or an external force. That is, there occurs a case where the tube 81 is not supported by the supporting surface 851*a*. In this case, for example, if the carriage 61 is moved to the second position while the tube 81 has fallen off from the supporting surface 851*a*, the tube 81 will be stuck between the carriage 61 and the frame 85, so that operation trouble of the carriage 61 or the like occurs.

To avoid this, the carriage 61 is moved along the scanning directions X to bring the inclined portion 610 of the carriage 61 into contact with the tube 81 so that the tube 81 is moved toward the supporting surface 851*a*. In this exemplary embodiment, as shown in FIG. 6, the carriage 61 is moved along the scanning directions X from the first position side to the second position side. Incidentally, the inclined portion 610 (the scoop-up inclined portion 620 and the urging inclined portion 630) is provided at the leading end side of the carriage 61 in the moving direction of the carriage 61. Therefore, as the carriage 61 moves, a portion of the tube 81 that is not supported by the supporting surface 851*a* and has fallen off therefrom first contacts the first inclined surface 620*a* of the scoop-up inclined portion 620. The height of the first inclined surface 620*a* is lowest at the end portion in a scanning direction X of the carriage 61 and gradually increases toward the central portion of the carriage 61 in the scanning direction X. Therefore, the tube 81 having come into contact with the first inclined surface 620*a* is scooped up to the height of the supporting surface 851*a*.

Subsequently, the carriage 61 is further moved to the second position side. Then, a portion of the tube 81 having been scooped up to the height of the supporting surface 851*a* comes into contact with the second inclined surface 630*a* of the urging inclined portion 630. The second inclined surface 630*a* is inclined so as to gradually become closer to the frame 85 with increase in the distance from an end of the second inclined surface 630*a* toward the central portion of the carriage 61 in the scanning direction X. Therefore, the tube 81 in contact with the second inclined surface 630*a* is urged to the frame 85 side. Due to this, the tube 81 that is not supported by but has fallen off from the supporting surface 851*a* is put back onto the supporting surface 851*a*.

In this exemplary embodiment, since the tube 81 and the FFC 82 are held by the tube-holding members 900, the tube 81 and the FFC 82, when both are not supported by the supporting surface 851*a*, are put back onto the supporting surface 851*a* by the inclined portion 610.

The aforementioned first position (home position HP) is a position which is set at a predetermined position within a movable range of the carriage 61 but outside a range where the carriage 61 moves back and forth during execution of recording and at which the carriage 61 remains stopped during a standby state during which recording is not executed and during a powered-off state of the liquid discharge apparatus 50 (during transportation or storage of the liquid discharge apparatus).

The above-described exemplary embodiment is capable of achieving the following effects.

If the tube 81 partly falls off from the supporting surface 851*a* while the carriage 61 is moving back and forth between the first position and the second position, the tube 81 having fallen off is scooped up, when the carriage 61 moves from the first position to the second position, to the height of the supporting surface 851*a* by the scoop-up inclined portion 620 of the inclined portion 610 provided on the carriage 61, and the scooped-up tube 81 is urged to the frame 85 side by the urging inclined portion 630 of the inclined portion 610. Due to this, the tube 81 having fallen off from the supporting surface 851*a* can easily be put back to the supporting surface 851*a* and therefore occurrence of operation trouble or the like can be prevented.

Exemplary Embodiment 2

Figure 7:
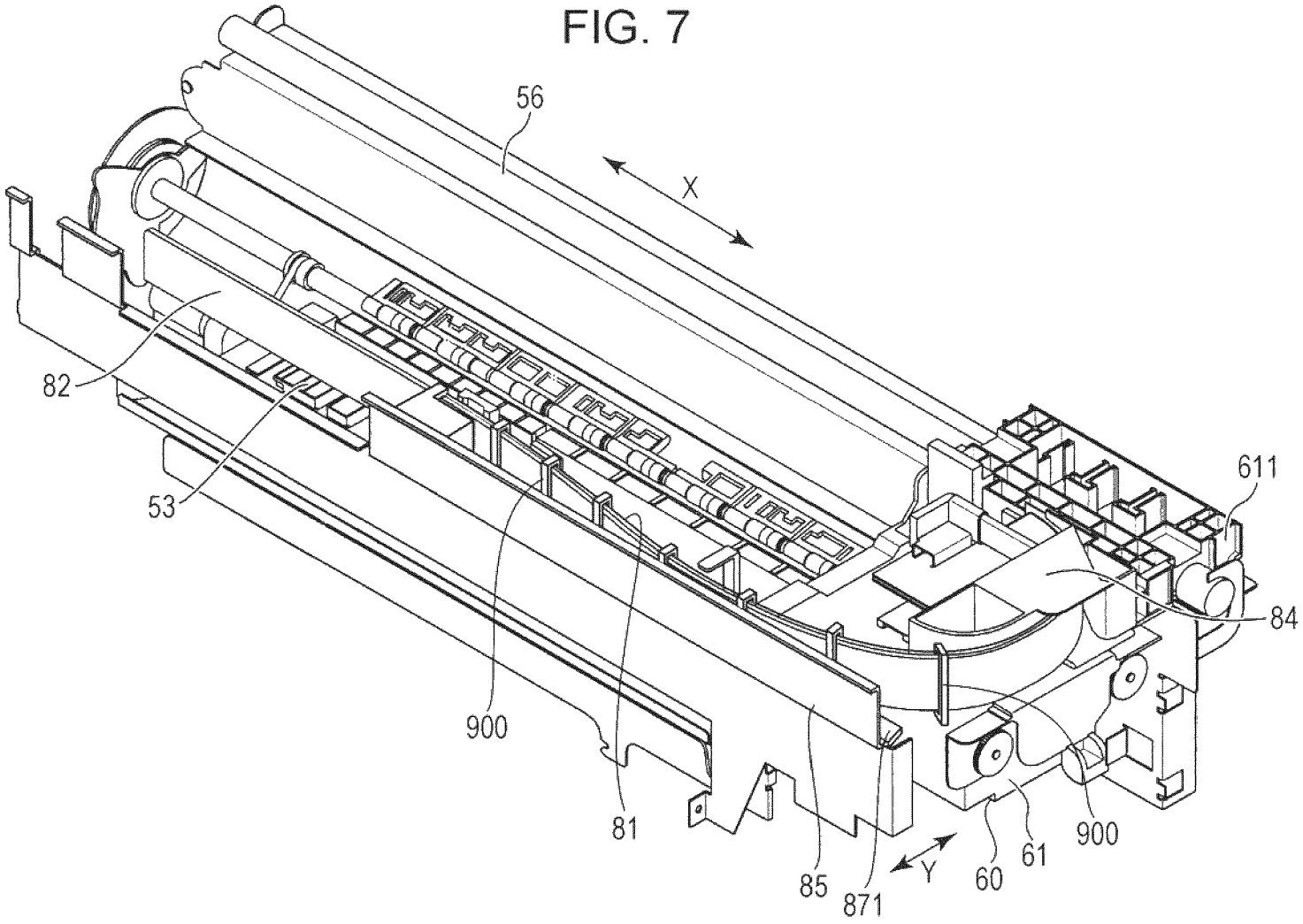
FIG. 7 is an enlarged partial view illustrating portions of a construction of a liquid discharge apparatus according to Exemplary Embodiment 2.
Figure 8:
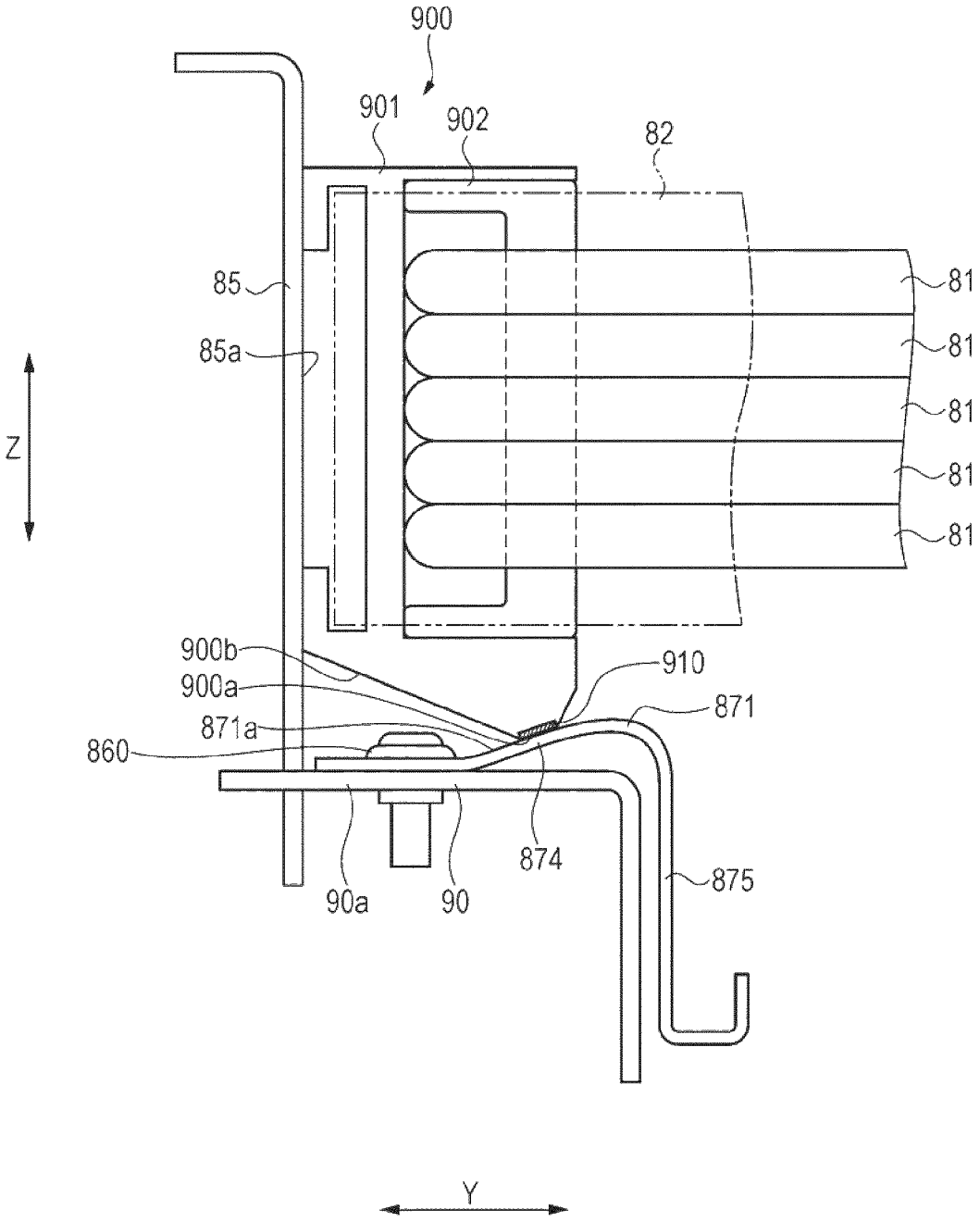
FIG. 8 is an enlarged partial view illustrating portions of a construction of the liquid discharge apparatus.

Next, a construction of a liquid discharge apparatus according to Exemplary Embodiment 2 will be described. FIG. 7 and FIG. 8 are enlarged partial views illustrating portions of a liquid discharge apparatus. Since a general construction of the liquid discharge apparatus in Exemplary Embodiment 2 is not substantially different from that in Exemplary Embodiment 1 illustrated in FIG. 1, components identical to those in Exemplary Embodiment 1 will be denoted by the same numerals and characters, and redundant descriptions will be avoided.

First, a supporting method for a tube 81 and a supporting construction for the tube 81 will be described. The supporting method for the tube 81 according to this exemplary embodiment is a tube supporting method for a liquid discharge apparatus 50 that includes a discharge portion 60 capable of discharging an ink, the tube 81 that is connected to the discharge portion 60 and that supplies an ink to the discharge portion 60, and a frame 85 provided at such a position as to be able to contact the tube. This tube supporting method supports the tube 81 between the discharge portion 60 and the frame 85 while urging the tube 81 in a direction toward the frame 85. The tube supporting method will be concretely described below.

As illustrated in FIG. 7 and FIG. 8, the frame 85 is provided at such a position as to be able to contact the tube 81. More concretely, the frame 85 having a frame surface 85*a* along the main scanning directions X in which the discharge portion 60 (carriage 61) moves is disposed. Furthermore, the tube 81 and the FFC 82 are connected to the carriage 61 via a connector member 84. As illustrated in FIG. 8, the frame 85 is connected to a base plate 90. A portion 90*a* of the base plate 90 is disposed in a substantially horizontal direction. The frame 85 is disposed substantially perpendicularly to the portion 90*a* of the base plate 90. Five tubes 81 that constitute the tube 81 are arranged so as to overlie each other in a substantially perpendicular direction to the portion 90*a* of the base plate 90. The length of the frame 85 corresponding to the frame surface 85*a* is designed to be longer than a dimension of the tube 81 in Z-axis directions.

Furthermore, a tube support portion 871 is provided between the discharge portion 60 and the frame 85. In this exemplary embodiment, the tube support portion 871 is provided so that the frame 85 and the tube support portion 871 are continuous with each other. The tube support portion 871 has a supporting surface 871*a* capable of supporting the tubes 81. The supporting surface 871*a* of the tube support portion 871 is inclined so that the tubes 81 that the supporting surface 871*a* supports are urged in a direction toward the frame 85. Concretely, the tube support portion 871 is configured so that the height of the tube support portion 871 in a Z-axis direction decreases gradually toward the frame 85. Therefore, when the tubes 81 are in contact with the supporting surface 871*a*, the tubes 81 are urged to the frame 85 side. That is, the tubes 81 are prevented from falling off from the supporting surface 871*a*.

Furthermore, the tubes 81 are held by the tube-holding members 900. Each of the tube-holding members 900 has a first holding portion 901 and a second holding portion 902, and performs a function of clamping and bundling the plurality of tubes 81 between the first holding portion 901 and the second holding portion 902. This prevents the tubes 81 from flapping when the carriage 61 moves back and forth. Incidentally, in this exemplary embodiment, not only the tubes 81 but also the FFC 82 is held by the tube-holding members 900. This prevents the tubes 81 and the FFC 82 from flapping.

Each tube-holding member 900 has a supported surface 900*a* that contacts the supporting surface 871*a* of the tube support portion 871. Due to this, the supporting surface 871*a* does not directly contact the tubes 81 or the like, so that damages to the tubes 81 or the like by friction or wear can be prevented. Furthermore, the supported surface 900*a* of each tube-holding member 900 is inclined so as to follow the inclination of the supporting surface 871*a*. Concretely, the height of the supported surface 900*a* that contacts the supporting surface 871*a* in the Z-axis direction decreases gradually toward the frame 85. Due to this, each tube-holding member 900 is urged toward the frame 85 due to the inclination of the supporting surface 871*a*. This makes less likely the falling off of the tube-holding members 900 together with the tubes 81.

Furthermore, the supported surface 900*a* of each tube-holding member 900 is configured so as to have a lower coefficient of dynamic friction than other portions of the tube-holding member 900. In this exemplary embodiment, a portion of each tube-holding member 900 which corresponds to the supported surface 900*a* is provided with a low-friction member tape 910 that has a lower coefficient of dynamic friction than other portions of the tube-holding members 900. This prevents abrasive degradation of the supported surface 900*a* and the supporting surface 871*a* due to friction between the supported surface 900*a* (low-friction member tape 910) and the supporting surface 871*a*.

In this exemplary embodiment, the tube support portion 871 has a unitary structure made up of a first member 874 that has the supporting surface 871*a* capable of supporting the tubes 81 and a second member 875 that does not support the tubes 81. The first member 874 is fixed to the portion 90*a* of the base plate 90 by a fixture portion 860. On the other hand, the second member 875 does not contact the base plate 90 but forms a free end. Therefore, when a tube-holding member 900 holding the tubes 81 and the FFC 82 comes into contact with the supporting surface 871*a* of the first member 874, the weight of the tubes 81, the FFC 82 and the tube-holding member 900 presses the tube support portion 871 in a gravity direction, so that an elastic force is produced since the tube support portion 871 has a cantilever structure. Thus, if external force occurs on the tubes 81, the FFC 82, etc., such external force is absorbed. Therefore, the tubes 81 and the FFC 82 can be more stably supported on the supporting surface 871*a*.

Figure 9:
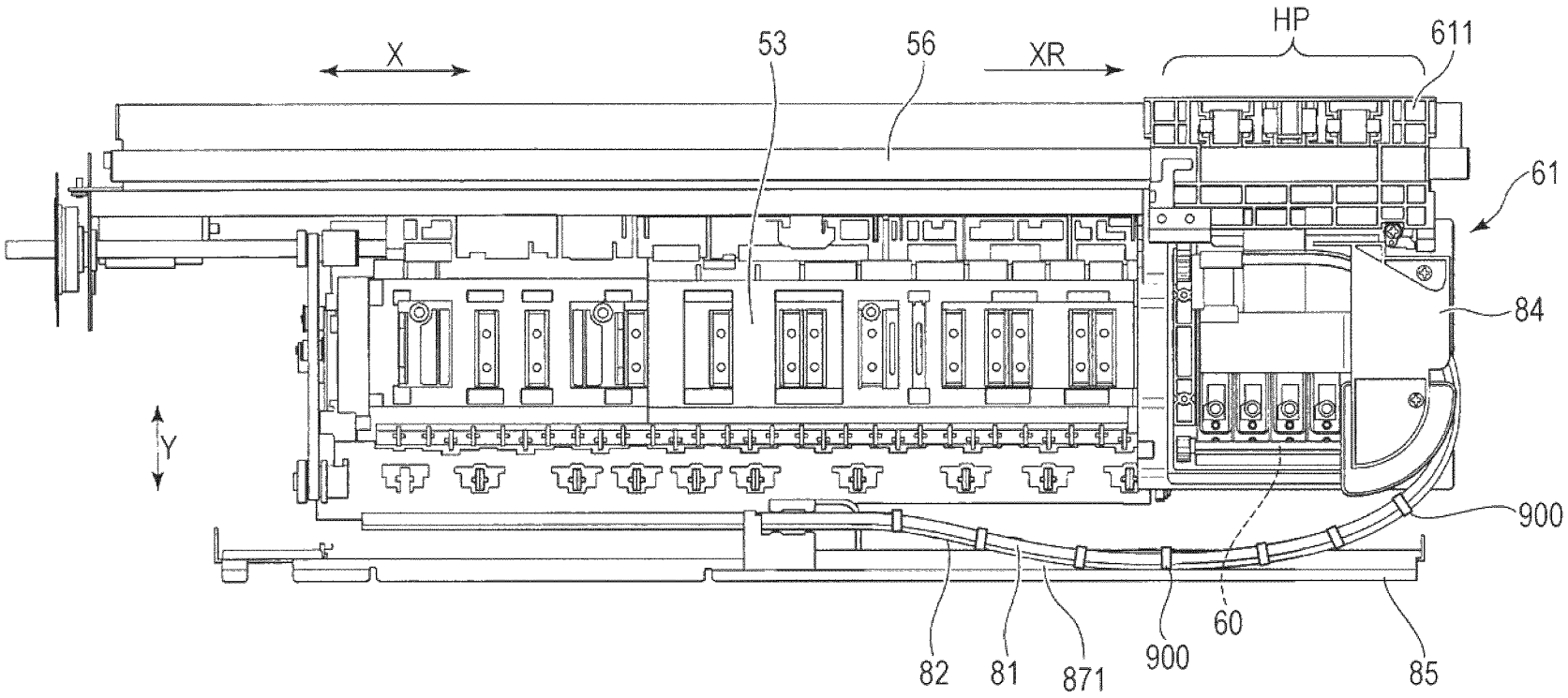
FIG. 9 is a schematic diagram illustrating an operation of the liquid discharge apparatus.
Figure 10:
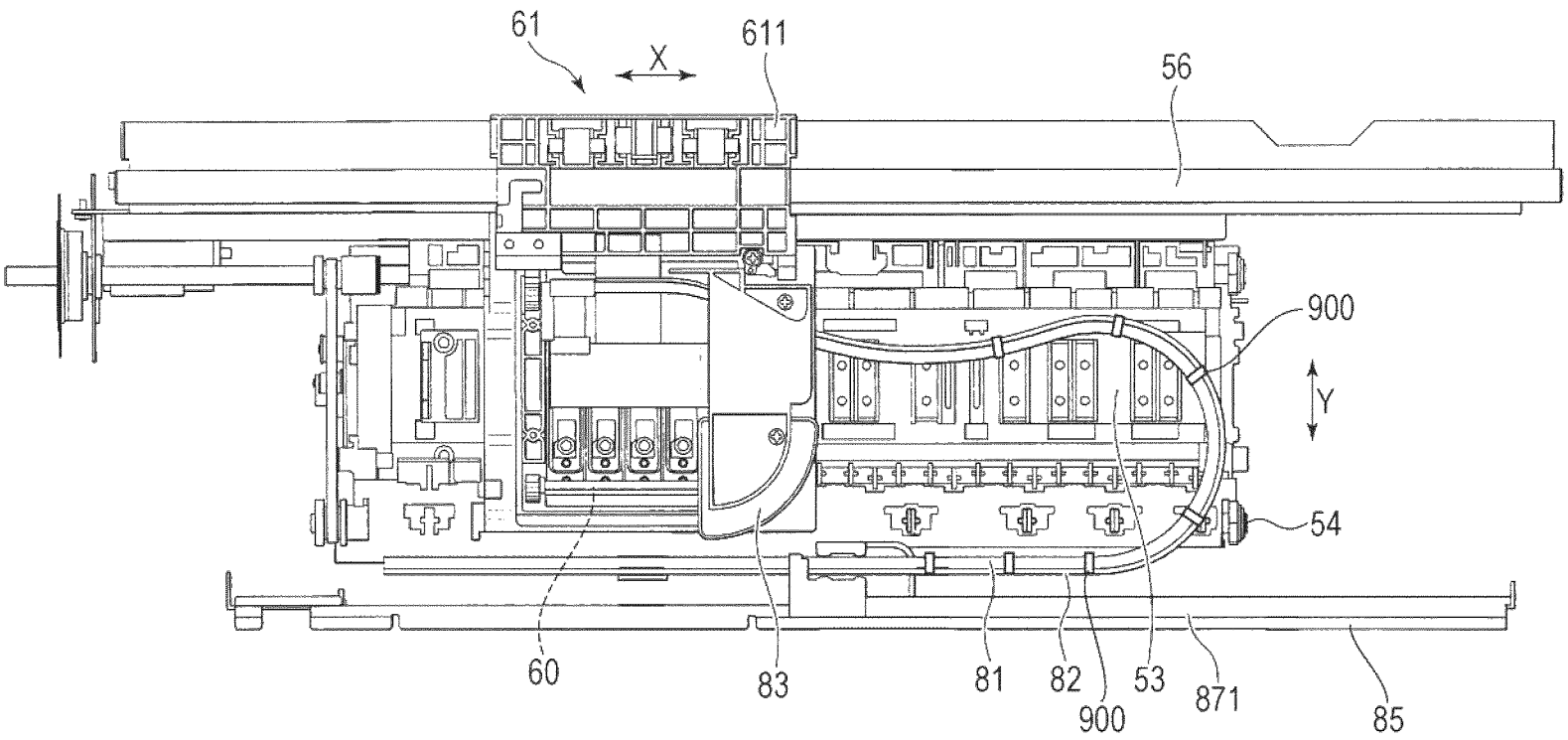
FIG. 10 is a schematic diagram illustrating an operation of the liquid discharge apparatus.

Next, operations of the liquid discharge apparatus will be described. FIG. 9 and FIG. 10 are schematic diagrams illustrating an operation of the liquid discharge apparatus. That is, FIG. 9 illustrates a case where the discharge portion 60 is at the first position (home position HP), and FIG. 10 illustrates a case where the discharge portion 60 is at the second position (the position when the discharge portion 60 has moved in a main scanning direction). The movement of the discharge portion 60 between the first position and the second position is accomplished by movement of the carriage 61.

When the discharge portion 60 (carriage 61) is positioned at the first position due to movement of the carriage 61 in a main scanning direction X, the tubes 81 are supported on the supporting surface 871*a* (FIG. 8). The tubes 81 are apart from the supporting surface 871*a* when the discharge portion 60 (carriage 61) is positioned at the second position. More specifically, the region of the tubes 81 apart from the supporting surface 871*a* is larger when the discharge portion 60 is at the second position than when the discharge portion 60 is at the first position. That is, when the discharge portion 60 is at the first position, the tubes 81 droop due to their own weight, leading to a risk of falling off from the supporting surface 871*a*. Therefore, a configuration is taken in which the tubes 81 are supported on the supporting surface 871*a* as much as possible. On the other hand, when the discharge portion 60 is at the second position, the tubes 81 are in a state of being drawn by the carriage 61, so that there is no risk of the tubes 871*a* falling off from the supporting surface 871*a*. Therefore, a configuration in which the tubes 81 are apart from the supporting surface 871*a* is taken. Incidentally, in this exemplary embodiment, since the tubes 81 and the FFC 82 are held by the tube-holding members 900, the tubes 81 and the FFC 82 are supported on the supporting surface 871*a* when the discharge portion 60 (carriage 61) is at the first position, and the tubes 81 and the FFC 82 are apart from the supporting surface 871*a* when the discharge portion 60 (carriage 61) is at the second position.

The aforementioned home position HP is a position which is set at a predetermined position within the movable range of the carriage 61 but outside the range where the carriage 61 moves back and forth during execution of recording and at which the carriage 61 remains stopped during the standby state during which recording is not executed and during the powered-off state of the liquid discharge apparatus 50 (during transportation or storage of the liquid discharge apparatus).

Thus, according to the foregoing exemplary embodiment, the following effects can be achieved.

The tube-holding members 900 holding the tubes 81 are supported by the supporting surface 871*a* of the tube support portion 871. Note that the supporting surface 871*a* of the tube support portion 871 is inclined so that the tube-holding members 900 is urged in a direction toward the frame 85. Therefore, the supporting surface 871*a* operates so that the tube-holding members 900 are pressed to the frame 85 side. Therefore, the tube-holding members 900 can be prevented from falling off from the tube support portion 871. Due to this, the operations of the carriage 61 in the liquid discharge apparatus 50 can be made stable.

The present invention is not limited to the foregoing exemplary embodiments but various changes, improvements, etc. can be made to the foregoing exemplary embodiments. Modifications will be described below.

Modification 1

Figure 11:
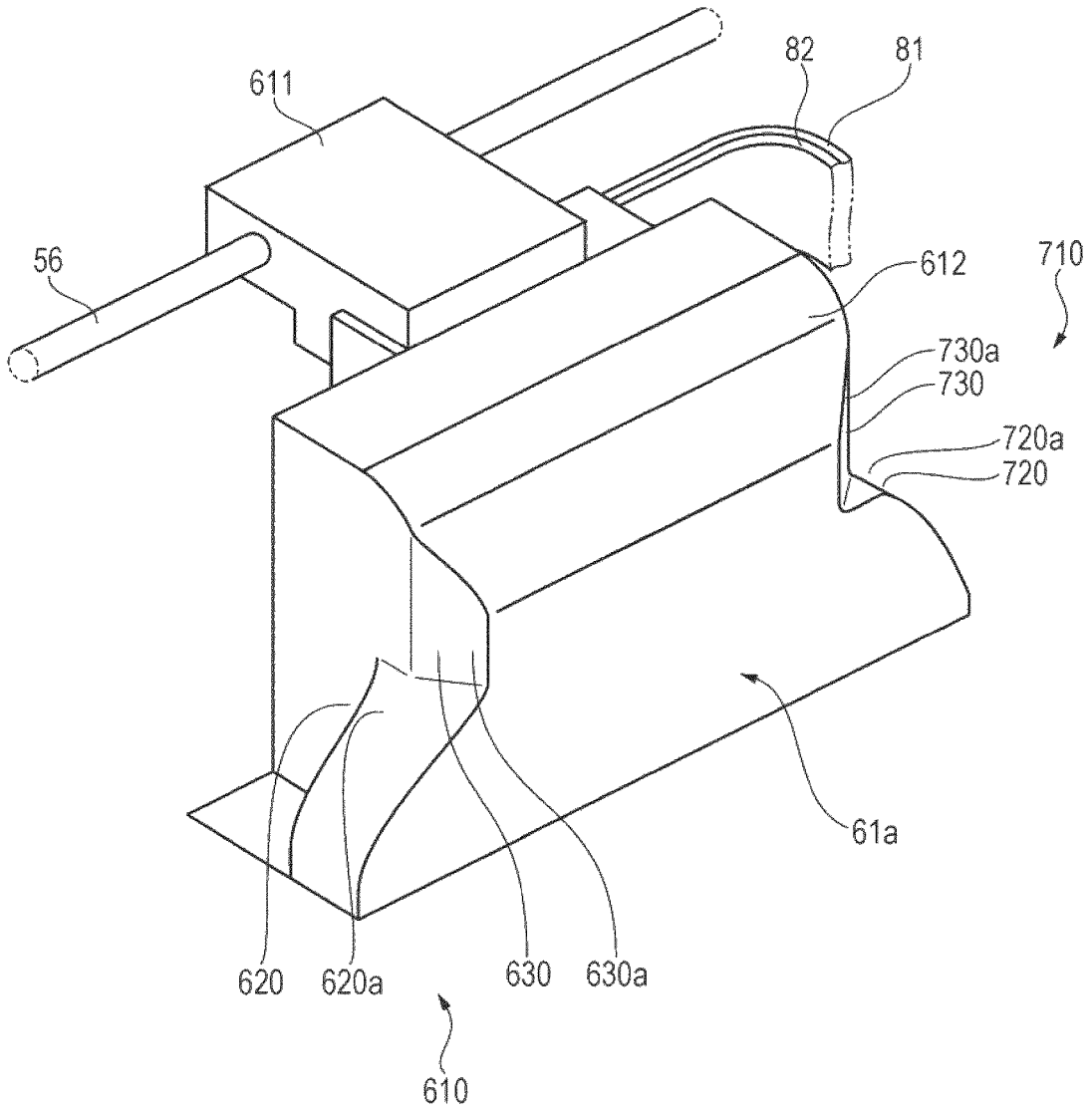
FIG. 11 is a schematic diagram illustrating a construction of a carriage according to Modification 1.

Although in Exemplary Embodiment 1 described above, the inclined portion 610 is provided on only one end side of the carriage 61 in the scanning directions X, the invention is not limited to this construction. For example, inclined portions may be provided at a first position-side end portion and a second position-side end portion of the carriage. FIG. 11 is a general construction diagram of a carriage according to this modification. As illustrated in FIG. 11, a carriage 61*a* according to this modification has an inclined portion 610 and another inclined portion 710. Concretely, the inclined portion 610 is provided on an end portion of the carriage 61 in a scanning direction X and the inclined portion 710 is provided on a second end portion opposite the end portion. The inclined portion 710, similar to the inclined portion 610, includes a scoop-up inclined portion 720 (first inclined surface 720*a*) and an urging inclined portion 730 (second inclined surface 730*a*). Basic constructions of the scoop-up inclined portion 720 (first inclined surface 720*a*) and the urging inclined portion 730 (second inclined surface 730*a*) of the inclined portion 710 are substantially the same as those of the inclined portion 610, and therefore will not be described in detail. This construction makes it possible to put the tubes 81 back to the supporting surface 851*a* regardless of in which one of the scanning directions X the carriage 61 moves.

Modification 2

Although the foregoing exemplary embodiments are described above in conjunction with an example of a construction of the generally termed off-carriage type liquid discharge apparatus 50, the invention is not limited so. For example, the liquid discharge apparatus 50 may be an on-carriage type liquid discharge apparatus in which an ink cartridge is mounted on the carriage. In this construction, substantially the same effects as stated above can be achieved. In this modification, since the tubes 81 are not present, the invention provides a construction for putting the FFC 82 (cable) having fallen off from the supporting surface 851*a* back to the supporting surface 851*a* and, furthermore, a construction for preventing the FFC 82 from falling off. That is, the invention is applicable regardless of whether the object of application is the tubes 81 or the cable. In this case, the tube support portions 851, 871 are cable support portions.

Modification 3

Although in the foregoing exemplary embodiments, the liquid discharge apparatus 50 transports the continuous sheet P in an elongated sheet shape, the invention is not limited so. For example, a construction in which cut sheets are used may also be adopted. Such a modification is also capable of achieving substantially the same effects as mentioned above.

The entire disclosure of Japanese Patent Application No.: 2014-152631, filed Jul. 28, 2014, and 2014-152633, filed Jul. 28, 2104 are expressly incorporated reference herein.

What is claimed is:

1. A liquid discharge apparatus comprising:

a discharge portion capable of discharging a liquid;

a tube connected to the discharge portion and capable of supplying the liquid to the discharge portion;

a frame provided at such a position as to be able to contact the tube; and, a tube support portion that is provided between the discharge portion and the frame and that has a supporting surface capable of supporting the tube; wherein the supporting surface of the tube support portion is inclined so that the tube is urged in a direction toward the frame.

2. The liquid discharge apparatus according to claim 1, further comprising:

a carriage on which the discharge portion is mounted and which is movable along scanning directions between a first position and a second position; wherein the tube is supported by the supporting surface when the carriage is at the first position, and the tube is apart from the supporting surface when the carriage is at the second position.

3. The liquid discharge apparatus according to claim 1, further comprising:

a tube-holding member that is connected to the tube and that has a supported surface that contacts the supporting surface.

4. The liquid discharge apparatus according to claim 3, wherein the supported surface of the tube-holding member is inclined so as to follow inclination of the supporting surface.

5. The liquid discharge apparatus according to claim 3, wherein the supported surface of the tube-holding member is a lower coefficient of dynamic friction than other portions of the tube-holding member.

6. The liquid discharge apparatus according to claim 1, wherein the frame and the tube support portion is provided so as to be continuous with each other.

* * * * *